US009493323B2

(12) United States Patent
Maeda

(10) Patent No.: US 9,493,323 B2
(45) Date of Patent: Nov. 15, 2016

(54) FIBER BUNDLE GUIDE

(71) Applicant: KAMITSU SEISAKUSHO LTD., Hyogo (JP)

(72) Inventor: Yoshiyasu Maeda, Nara (JP)

(73) Assignee: KAMITSU SEISAKUSHO LTD., Hyogo (JP)

( * ) Notice: Subject to any disclaimer, the term of this patent is extended or adjusted under 35 U.S.C. 154(b) by 275 days.

(21) Appl. No.: 14/501,566

(22) Filed: Sep. 30, 2014

(65) Prior Publication Data

US 2015/0014473 A1 Jan. 15, 2015

Related U.S. Application Data

(63) Continuation of application No. PCT/JP2013/053030, filed on Feb. 8, 2013.

(30) Foreign Application Priority Data

May 2, 2012 (JP) ..... 2012-105412

(51) Int. Cl.

| | |
|---|---|
| ***B65H 57/14*** | (2006.01) |
| ***B65H 23/038*** | (2006.01) |
| ***B65H 57/28*** | (2006.01) |
| ***D02J 1/22*** | (2006.01) |

(52) U.S. Cl.

CPC ..... *B65H 57/14* (2013.01); *B65H 23/038* (2013.01); *B65H 57/28* (2013.01); *D02J 1/225* (2013.01); *B65H 2701/314* (2013.01)

(58) Field of Classification Search

CPC ..... B65H 20/02; B65H 57/14; B65H 57/28; B65H 2701/314; B65H 23/035; B65H 23/038

USPC ..... 242/615.1; 226/21

See application file for complete search history.

(56) References Cited

U.S. PATENT DOCUMENTS

| | | | |
|---|---|---|---|
| 8,123,156 | B2 | 2/2012 | Mishima et al. |
| 8,132,754 | B2 | 3/2012 | Mishima et al. |

(Continued)

FOREIGN PATENT DOCUMENTS

| | | | |
|---|---|---|---|
| JP | 2005-247582 | A | 9/2005 |
| JP | 2006-274497 | A | 10/2006 |
| JP | 2007-169060 | A | 7/2007 |

(Continued)

OTHER PUBLICATIONS

International Search Report dated Mar. 19, 2013 issued in corresponding PCT/JP2013/053030 application (pp. 1-2).

(Continued)

*Primary Examiner* — William E Dondero

(74) *Attorney, Agent, or Firm* — Millen, White, Zelano & Branigan, P.C.; William Nixon

(57) ABSTRACT

A fiber bundle guide 1 includes a cylindrical guide roller 11, a support member 12 which rotatably supports the guide roller 11, and a movable mechanical section 13 arranged between the guide roller 11 and the support member 12, so that the guide roller 11 swings in response to widthwise changes in the traveling path of the fiber bundle Y. According to this fiber bundle guide, it is possible to prevent excessive shifting of the fiber bundle Y toward one of both sides of the circumferential edge of the guider roller 11, preventing shrinking or bending of the fiber bundle Y due to the contact of the fiber bundle Y to the flange 112 of the guide roller 11, which makes it possible to guide the fiber bundle Y without causing twisting of the bundle.

16 Claims, 8 Drawing Sheets

(56) References Cited

U.S. PATENT DOCUMENTS

| | | | |
|---|---|---|---|
| 2007/0163226 | A1 | 7/2007 | Mishima et al. |
| 2010/0270416 | A1 | 10/2010 | Mishima et al. |

FOREIGN PATENT DOCUMENTS

| | | | |
|---|---|---|---|
| JP | 2008-544100 | A | 12/2008 |
| WO | 2005/073118 | A1 | 8/2005 |

OTHER PUBLICATIONS

English Translation Abstract of JP 2005-247582 published Sep. 15, 2005.

English Translation Abstract of JP 2006-274497 published Oct. 12, 2006.

English Translation Abstract of JP 2007-169060 published Jul. 5, 2007.

English Translation Abstract of DE 102005029400 (corresponds to JP 2008-544100) published Jan. 4, 2007.

FIBER BUNDLE GUIDE

This application is a continuation of International Application No. PCT/JP2013/053030, filed on Feb. 8, 2013, claiming the benefits of Japanese Patent Application No. 2012-105412, filed on May 2, 2012, the entire disclosure of each of both applications is incorporated herein by reference in its entirety.

BACKGROUND OF THE INVENTION

1. Field of the Invention

The present disclosure relates to a fiber bundle guide for guiding a flat fiber bundle in which a plurality of fibers are gathered.

2. Description of the Related Art

The following description of related art sets forth the inventor's knowledge of related art and certain problems therein and should not be construed as an admission of knowledge in the prior art.

In general, when winding a thread to a winding apparatus, a guide is arranged on a traveling path of a thread so that the thread is guided to the winding apparatus by the guide. The guide is provided with a cylindrical guide roller having flanges formed on both circumferential side edges thereof, and a support member which supports the guide roller rotatably in a circumferential direction. With a thread put on a circumferential surface of the guide roller, the guide roller guides the thread towards the winding apparatus while rotating in response to the traveling of the thread with the support member as a rotational axis (see, e.g., Japanese Unexamined Patent Application Publication No. H7-237814).

By the way, recently, as represented by a carbon fiber bundle, it is performed to wind a flat fiber bundle in which a plurality of fibers are gathered with a winding apparatus. Also for this flat fiber bundle, it is required to provide a guide for guiding the fiber bundle, but a conventional guide as mentioned above has been applied as it is.

However, when a conventional guide is applied to a flat fiber bundle as it is, the following problems occur. Namely, a flat fiber bundle is constituted by gathering a plurality of fibers into a flat shape and therefore the tensile force differs depending on the portion of the fiber bundle, causing a variation of tensile forces as a whole. For this reason, when the fiber bundle is traveling along the circumferential surface of the guide roller, the fiber bundle gradually shifts to the flange side of the guide roller inadvertently due to the variation of tensile forces. This causes a contact of the fiber bundle to the flange, resulting in, e.g., shrinking or bending of the fiber bundle, which in turn causes twisting of the fiber bundle. For this reason, the fiber bundle fed from the guide roller is sent to a winding apparatus with the twists remained, which causes a problem that the fiber bundle is not wound accurately by the winding apparatus.

The description herein of advantages and disadvantages of various features, embodiments, methods, and apparatus disclosed in other publications is in no way intended to limit the present invention. For example, certain features of the described embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The disclosed embodiments of the present invention have been developed in view of the above-mentioned and/or other problems in the related art. The disclosed embodiments of the present invention can significantly improve upon existing methods and/or apparatuses.

The embodiments of the present invention have been made in view of the above mentioned problems, and aim to provide a fiber bundle guide capable of guiding a flat fiber bundle without causing twisting of the fiber bundle and therefore capable of winding the fiber bundle by a winding apparatus with high accuracy.

In order to attain the object, some embodiments of the present invention provide a fiber bundle guide for guiding a flat fiber bundle in which a plurality of fibers are gathered. For example, the fiber bundle guide may be provided with a cylindrical guide roller having a circumferential surface around which the fiber bundle is to be put, and a support member configured to rotatably support the guide roller in a circumferential direction, and is characterized in that the guide roller swings or tilts in response to widthwise changes in a traveling path of the fiber bundle.

According to this, the guide roller swings or tilts in response to widthwise changes in a traveling path of the flat fiber bundle, which can prevent excessive shifting of the flat fiber bundle toward both circumferential side edges of the guide roller. This prevents possible shrinking or bending of the fiber bundle due to the contract of the fiber bundle to the flange of the guide roller, which enables guiding of the flat fiber bundle without causing twisting thereof.

Further, at a rotatably supporting portion which rotatably supports the guide roller around the support member, it is provided with an axis receiving member arranged at a center part of the guide roller, an axis body slidably engaged with an inner side of the axis receiving member, and a swinging shaft arranged inside the axis body so as to extend in a direction perpendicular to a rotational axis of the guide roller to pivotally support the support member. The guide roller rotates about the support member in response to a traveling of the fiber bundle, and swings about the swinging shaft in response to widthwise changes in a traveling path of the fiber bundle. With this, the mechanism to rotate and swing the guide roller can be consolidated at the rotatably supporting portion for rotatably supporting the guide roller around the support member, and therefore it is possible to make the fiber bundle guide entirely compact and to swing the guide roller with high accuracy.

Also, it may be desirable that the swinging shaft is arranged at a position eccentrically shifted in a radius direction with respect to a center point of the guide roller. With this, the guide roller easily becomes in a vertical state, which enables stable rotation and swing of the guide roller.

Also, it may be desirable to further include an angle indicating member which extends from a side of the support member in a direction intersecting with the support member. With this, by rotating the angle indicating member, it is possible to change the inclination angle of the swinging shaft via the support member. Also, by recognizing the position and angle of the angle indicating member, it is possible to easily recognize the inclination angle of the swinging shaft.

Also, it is preferable to further include a scale board extending in a direction intersecting with the support member at a position adjacent to the angle indicating member. With this, the rotation amount of the angle indicating member can be recognized from the position of the angle indicating member with respect to the scale board, and therefore it is possible to accurately set the inclination angle of the swinging shaft on the basis of that.

Also, when an angle between the swinging shaft and the horizontal direction is denoted by H, the swinging shaft is preferably arranged so as to incline with respect to the horizontal direction so that the angle K represented by the below (Equation 1) falls within 5 to 35° (degrees), preferably 10 to 30° (degrees), more preferably 15 to 30° (degrees). According to this, hunting (short cycle swinging) hardly occurs, and it becomes easy to automatically return the flat fiber bundle to the original traveling path, which in turn can guide the fiber bundle more stably.

In one embodiments, a fiber bundle guide for guiding a flat fiber bundle, includes a cylindrical guide roller having a circumferential surface around which the fiber bundle is to be placed; a support member configured to support the cylindrical guide roller; a bearing arranged between the guide roller and the support member to rotatably support the cylindrical guide roller around the support member, the bearing including an outer ring and an inner ring; and a swinging shaft arranged inside the inner ring so as to extend in a direction perpendicular to a rotational axis of the guide roller to pivotally connect the inner ring and the support member.

According to some embodiments of the present invention, the guide roller swings in response to widthwise changes in a traveling path of the fiber bundle, which prevents excessive shifting of the flat fiber bundle toward both side edges of the circumferential side edges of the guide roller. This prevents possible occurrences of shrinking or bending of the fiber bundle due to the contract of the fiber bundle to the flange of the guide roller. Therefore, it is possible to guide the fiber bundle without causing twisting of the fiber bundle, which in turn makes it possible to wind the fiber bundle with a winding apparatus with high accuracy.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

BRIEF DESCRIPTION OF THE DRAWINGS

The disclosed embodiments of the present invention are shown by way of example, and not limitation, in the accompanying figures, wherein:

FIG. 3(*b*) is an enlarged front view showing an important part of the fiber bundle guide;

DETAILED DESCRIPTION OF EMBODIMENTS

In the following paragraphs, some embodiments of the invention will be described by way of example and not limitation. It should be understood based on this disclosure that various other modifications can be made by those in the art based on these illustrated embodiments.

First Embodiment

Next, a first embodiment of a fiber bundle guide of the present invention will be described with reference to FIGS. 1 to 7.

Figure 1:
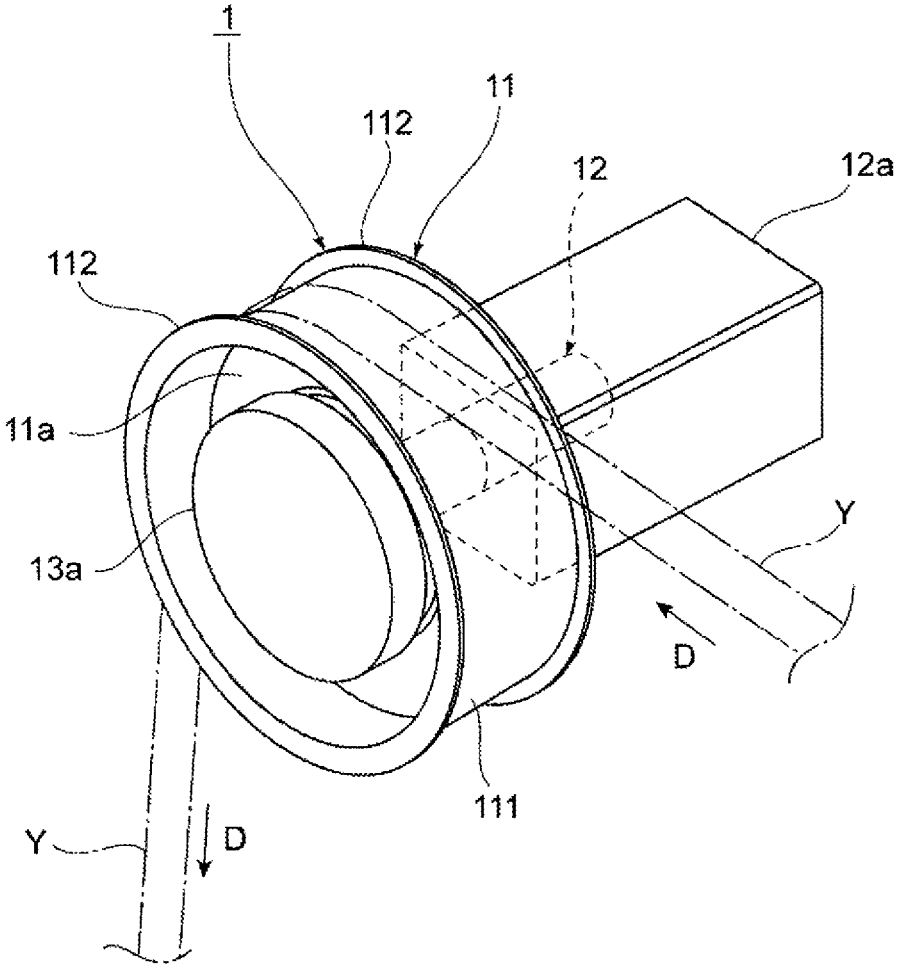
FIG. 1 is a perspective view showing a fiber bundle guide according to a first embodiment.
Figure 2:
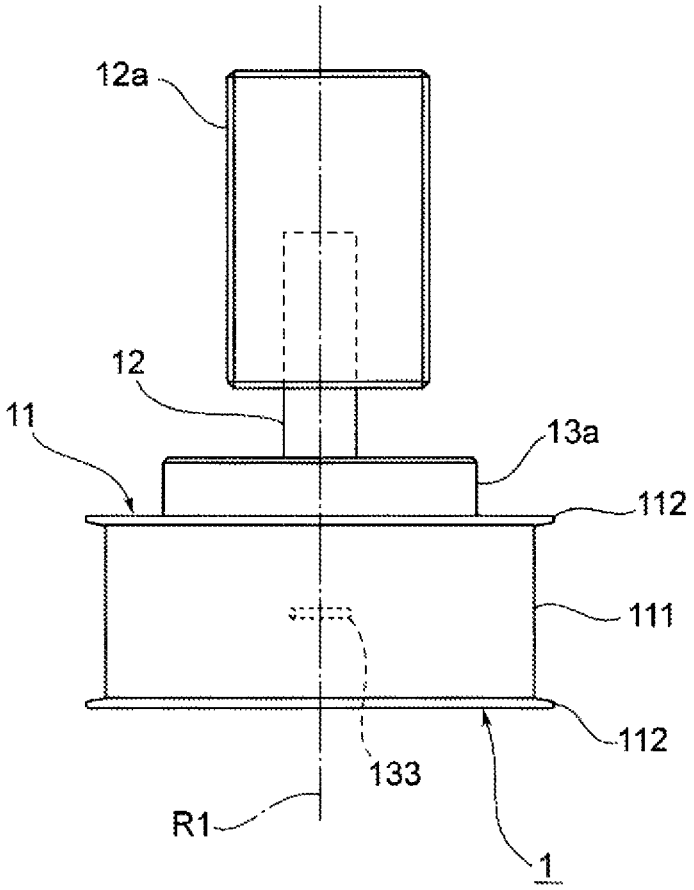
FIG. 2 is a plan view showing the fiber bundle guide shown in FIG. 1.
Figure 4:
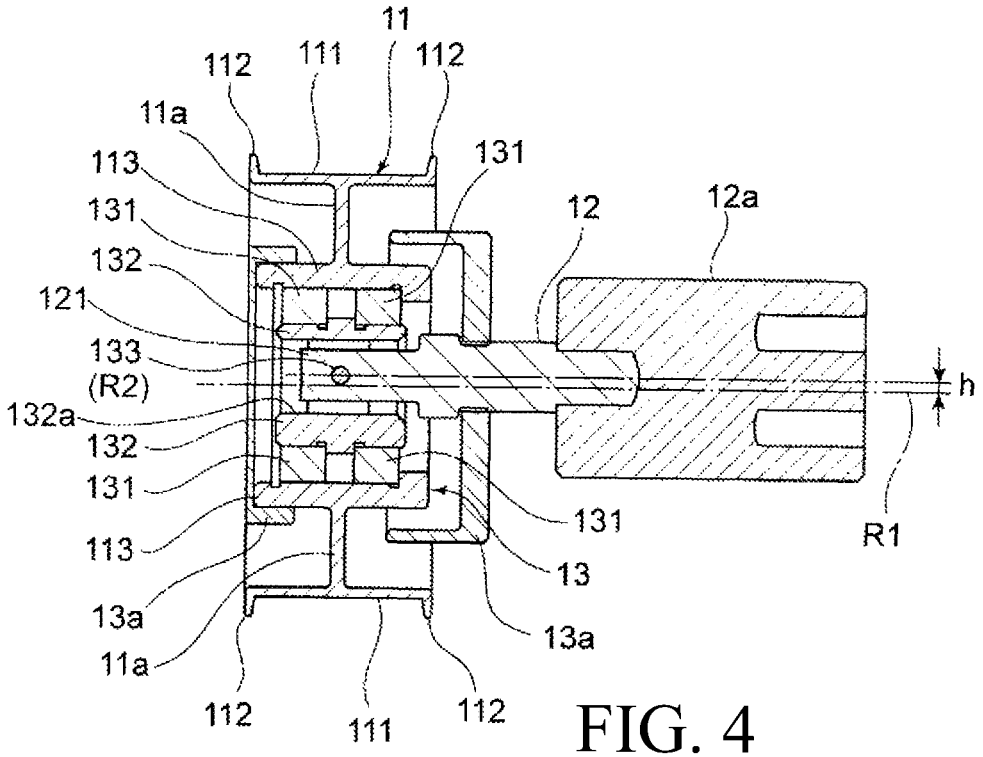
FIG. 4 is a cross-sectional view taken along the line IV-IV in FIG. 3(*a*) and seen from the arrow direction.

The fiber bundle guide 1 of this embodiment (hereinafter referred to as "this guide") is a member for guiding a flat fiber bundle in which a plurality of fibers are gathered. As shown in FIGS. 1 and 4, the guide 1 is provided with a guide roller 11 formed into a cylindrical shape, a support member 12 which supports the guide roller 11, and a movable mechanical section 13 arranged between the guide roller 11 and the support member 12.

By the way, the fiber bundle Y described in this disclosure is a carbon fiber bundle, and a traveling direction of the fiber bundle Y is indicated by an arrow D in each figure. It should be noted that the carbon fiber bundle is one of preferred embodiments of the fiber bundle as defined in the present invention, and is not limited to that.

The guide roller 11 is provided with a circumferential surface 111 formed on the outer circumferential part, flanges 112 formed at both side edges of the circumferential surface 111 and radially outwardly extended, a cylindrical axis receiving member 113 arranged on the center part of the roller 11.

Figure 5:
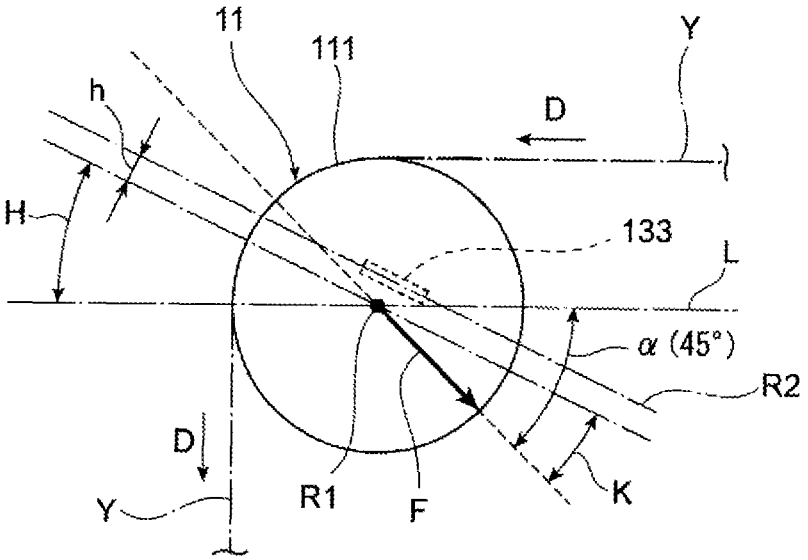
FIG. 5 is a schematic front view showing an inclination angle, etc., of a swinging shaft of the fiber bundle guide shown in FIG. 1.

For the guide roller 11, the fiber bundle Y is put from the above on the circumferential surface 111 formed into a cylindrical shape. Specifically, as shown in FIGS. 1 to 5, the fiber bundle Y traveling along the horizontal direction L from the right side of the roller 11 in FIG. 1 reaches the upper part of the circumferential surface 111 of the roller 11, travels along the circumferential surface 111 of the roller 11 as it is, and then leaves downward from the left side of the circumferential surface 111 of the roller 11. At this time, as shown in FIG. 5, the roller 11 is in a state in which the roller 11 receives a tensile force F (a total force of tensile forces) right diagonally downward by the fiber bundle Y. The angle between the direction of the tensile force F and the horizontal direction L (in this embodiment, the incoming traveling direction of the fiber bundle Y is parallel to the horizontal direction L) is denoted by $\alpha$ (45° (degrees) in this embodiment).

Also, this roller 11 is provided with flanges 112 in a manner such that the flanges 112 are formed so as to extend from both side edges of the circumferential surface 111 to prevent possible detachments of the fiber bundle Y traveling on the circumferential surface 111 in the widthwise direction. Further, the axis receiving member 113 is connected to the circumferential surface 111 via a connection piece 11*a*. A roller 131 constituting the movable mechanical section 13, which will be explained later, is in contact with the inner circumferential surface of the axis receiving member 113.

The support member 12, as shown in FIG. 4, is a rod-like member which is fixed in a manner to protrude in a horizontal direction L from a side surface of a fixing member 12*a* fixed to a certain member. The support member 12 pivotally supports the guide roller 11 via the movable mechanical section 13, so that the guide roller 11 rotates in the circumferential direction about a rotational axis R1. By the way, as it will be mentioned blow, the support member 12 pivotally supports the guide roller 11 in a state in which the guide roller 11 is eccentrically shifted by the distance h radially upward. Therefore, the rotational axis R1 of the guide roller 11 is shifted radially upward by the distance h from the central axis of the support member 12. However, the rotational axis R1 passes through the inside of the support member 12, and therefore it can be assumed that the guide roller 11 rotates about the support member 12.

The movable mechanical section 13, as shown in FIG. 4, is a mechanism for supporting the guide roller 11 in a rotatable and swingable manner with respect to the support member 12 at the pivotally supporting section which pivotally supports the guide roller 11 around the support member 12. Specifically, the movable mechanical section 13 is provided with a cylindrical roller 131 in contact with the inner circumferential surface of the axis receiving member 113 of the guide roller 11, a cylindrical axis body 132 arranged radially inward of the roller 131, and a columnar swinging shaft 133 arranged on the inner side of the axis body 132.

The roller 131 is one of the plurality of cylindrical rollers arranged in parallel to each other on the inner side of the guide roller 11. The roller 131 is arranged in a manner such that the roller 131 is in contact with the inner circumferential surface of the axis receiving member 113 of the guide roller 11 and in contact with the outer circumferential surface of the axis body 132, and constitutes a so-called cylindrical roller bearing structure in which the roller 131 slidably moves on the inner circumferential surface of the axis receiving member 113 and the outer circumferential surface of the axis body 132. In other words, the aforementioned axis receiving member 113, rollers 131, and axis body 132 constitute a so-called roller bearing. In general, the axis receiving member 113 may be called an outer ring or outer race, the axis body 132 may be called an inner ring or inner race.

The axis body 132 (inner ring) is engaged with the inside of the roller 113 in a slidable manner by the aforementioned cylindrical roller bearing structure. For this reason, the guide roller 11 can be rotated smoothly in the circumferential direction via each roller 131 with respect to the axis body 132. By the way, in this embodiment, the cylindrical roller bearing structure is employed, but other bearing mechanism structures, such as, e.g., a ball bearing structure, a conical bearing structure, or a slidable bearing structure, can be employed.

Figure 3A:
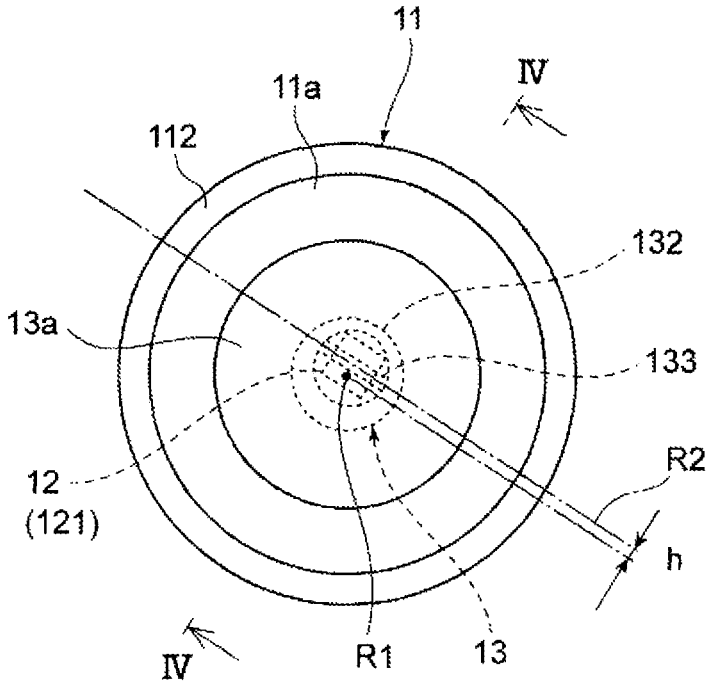
FIG. 3(*a*) is a front view showing the fiber bundle guide shown in FIG. 1.
Figure 3B:
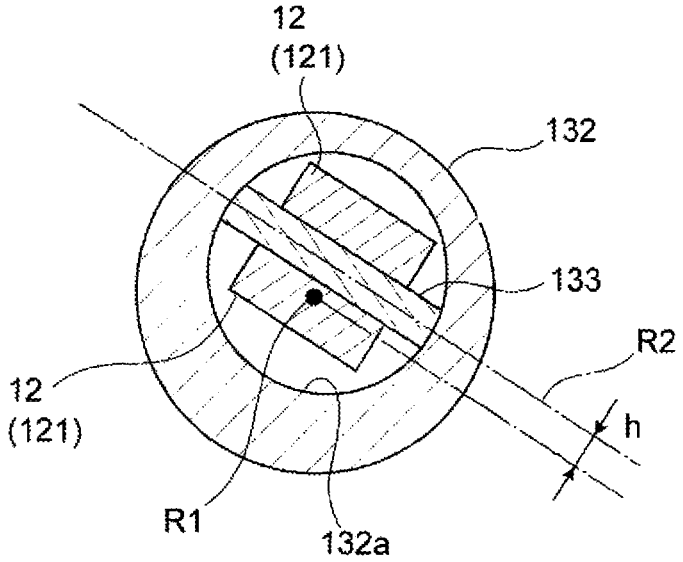

Also, the axis body 132 is, as shown in FIGS. 3 and 4, provided with a hollow part 132*a* which is circular in cross-section and configured to receive the tip end part 121 of the support member 12. The center position of the hollow part 132*a* is formed in a manner such that the center position is shifted radially upward from the center position of the shaft member 132. With this, the swinging shaft 133, which will be explained later, can be readily shifted radially upward.

By the way, cover members 13*a* are arranged on both left and right sides of the guide roller 11 to prevent possible invasion of dusts, etc., into the inside of the movable mechanical section 13.

The swinging shaft 133, as shown in FIG. 3, is arranged in the hollow part 132*a* of the axis body 132 so as to extend in a direction perpendicular to the rotational axis R1 of the roller 11 to pivotally support the support member 12 inserted in the hollow part 132*a* of the shaft member 132. With this, the guide roller 11 can swing about the swinging axis R2 constituted by the swinging shaft 133.

Also, the swinging shaft 133, as shown in FIG. 5, is arranged so as to incline at an angel H to the horizontal direction L. Although the details will be described in the following example, by arranging the swinging shaft 133 at an inclination angle of H, it becomes possible to make the guide roller 11 stably swing in response to widthwise changes in the traveling path of the fiber bundle Y.

Also, the swinging shaft 133, as shown in FIGS. 3 to 5, is arranged at a position eccentrically shifted radially upward with respect to the center point (the center point of the rotational axis R1) of the roller 11. In this embodiment, the guide roller 11 is arranged at the position apart from the rotational axis R1 of the roller 11 by the distance h radially outward. For this reason, the roller 11 easily becomes in the vertical state, which makes it possible to rotate and move the roller 11 stably.

Next, the operations of the guide 1 will be described with reference to the figures.

As shown in FIG. 1, the fiber bundle Y travels along the horizontal direction from the right side of the guide roller 11, reaches the upper side of the circumferential surface 111 of the guide roller 11, travels along the circumferential surface 111 of the roller 11 as it is, and leaves downward from the left side of the circumferential surface 111 of the guide roller 1. In accordance with the traveling of the fiber bundle Y, the guide roller 11 rotates about the support member 12 (rotational axis R1).

When the traveling path of the fiber bundle Y is positioned in the widthwise center of the guide roller 11, the fiber bundle Y is positioned right above the swinging axis R2. For this reason, the guide roller 11 does not swing about the swinging axis R2, and guides the fiber bundle Y on the original traveling path while maintaining the vertical state. In this disclosure, the original traveling path denotes a traveling path when the fiber bundle Y is traveling on the widthwise center of the guide roller 11 in the vertical state.

Here, when the traveling path of the fiber bundle Y is changed to one of widthwise sides, the guide roller 11 inclines or tilts about the swinging axis R2.

Figure 6A:
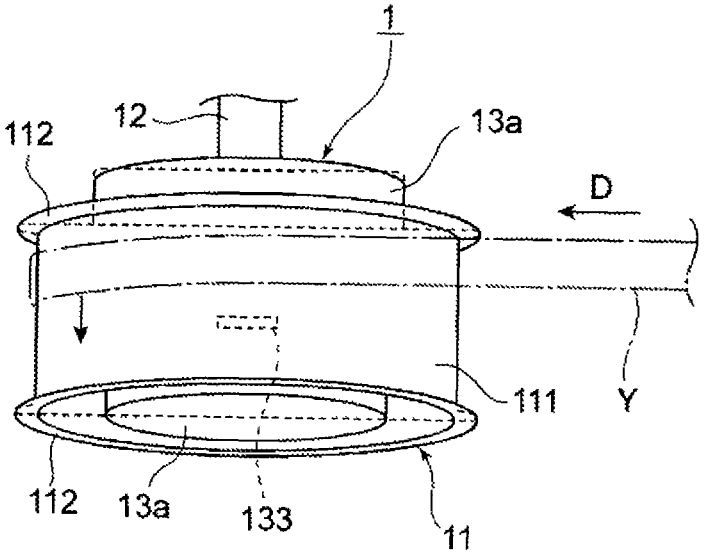
FIG. 6(*a*) is a plan view showing a state when the fiber bundle guide shown in FIG. 1 is inclined rightward with respect to the traveling direction, and FIG. 6(*b*) is a plan view showing a state when the fiber bundle guide is inclined leftward with respect to the traveling direction.
Figure 6B:
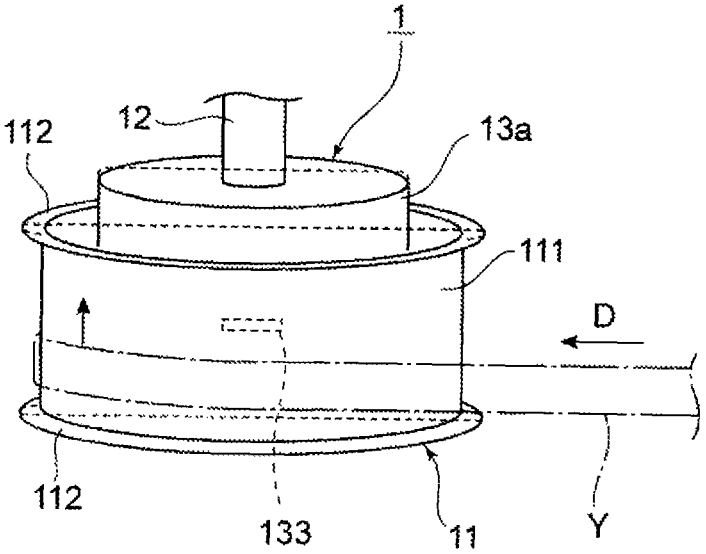

Explaining more specifically, as shown in FIG. 6(*a*), when the traveling path of the fiber bundle Y is changed to the right side in the traveling direction D, a rotational moment is generated in the right side in the traveling direction with respect to the guide roller 11 in accordance with the change in the traveling path. As a result, the guide roller 11 inclines rightward with respect to the traveling direction D about the swinging axis R2 to become a right inclined state, which prevents the contact of the fiber bundle Y to the flange 112 of the roller 11. Thereafter, when the fiber bundle Y starts returning to the original traveling path, a rotational moment is generated leftward with respect to the traveling direction of the roller 11. This makes the roller 11 incline about the swinging axis R2 leftward with respect to the traveling direction D, so the roller 11 returns to the original vertical state (as shown by the broken lines in the figure) to guide the fiber bundle Y on the original traveling path.

On the other hand, as shown in FIG. 6(*b*), when the traveling path of the fiber bundle Y is changed to the left side in the traveling direction D, a rotational moment is generated in the left side of the traveling direction of the roller 11 in accordance with the traveling path change. As a result, the roller 11 inclines leftward with respect to the traveling direction about the swinging axis R2 to become a left inclined state, which prevents the contact of the fiber bundle Y to the flange 112 of the guide roller 11. Thereafter, when the fiber bundle Y starts returning to the original traveling path, a rotational moment is generated rightward with respect to the traveling direction of the roller 11. This makes the roller 11 incline about the swinging axis R2 rightward with respect to the traveling direction, so the roller 11 returns to the original vertical state (as shown by the dotted lines in the figure) to guide the fiber bundle Y on the original traveling path.

In this manner, when the traveling path of the fiber bundle Y is changed in one of widthwise directions, the guide roller 11 swings or inclines about the swinging axis R2, which prevents excessive shifting of the fiber bundle Y toward one of both sides of the circumferential edge of the guide roller 11. This prevents possible shrinking or bending of the fiber bundle Y due to the contract of the fiber bundle Y to the flange 112 of the guide roller 11, which makes it possible to guide the fiber bundle Y without causing twisting of the fiber bundle. This in turn makes it possible to wind the fiber bundle with a winding apparatus with high accuracy.

In this embodiment, the above explanation was directed to the case in which the swinging axis R2 is arranged at the position eccentrically shifted radially upward with respect to the center point. However, it should be noted that the swinging axis R2 can be arranged at the position eccentrically shifted radially downward with respect to the center point of the guide roller 11. The explanation was directed to the case in which the swinging axis R2 is arranged at the position eccentrically shifted radially with respect to the center point of the guide roller 11. However, it should be noted that the swinging shaft is not required to be eccentrically shifted.

Also, the explanation was directed to the case in which the swinging axis R2 is arranged at the widthwise center of the guide roller 11, but the swinging shaft can be arranged in a different position.

Also, the explanation was directed to the case in which the guide roller 11 is supported by the support member 12 in a rotatable and swingable/tiltable manner by the movable mechanical section 13, but the guide roller 11 can be supported in a rotatable and swingable/tiltable manner by other mechanisms.

The explanation was directed to the case in which the roller 131 constituting the ball bearing is a cylindrical member, but the roller 131 can be a ball-shaped member.

Also, the explanation was directed to the case in which the axis body (inner ring) 132 is slidably engaged with the axis receiving member (outer ring) 113 via the roller 131, however the axis body (inner ring) 132 can be directly engaged with the axis receiving member (outer ring) 113 in a slidable manner.

Also, the explanation was directed to the case in which the fiber bundle Y is a carbon fiber bundle, but the fiber bundle can be a fiber bundle formed by materials other than the carbon fiber.

Also, the angle $\alpha$ between the direction of the tensile force F that the guide roller 11 receives from the fiber bundle Y and the horizontal direction L is set to 45° (degrees), but the angle $\alpha$ may change depending on the direction that the fiber bundle Y is placed.

EXAMPLES

Next, examples of the guide 1 will be described with reference to experimental data.

In this Example, as shown in FIG. 5, when the angle between the direction of the tensile force F (total force) that the roller 11 receives from the fiber bundle Y and the horizontal direction L is denoted by $\alpha$, and the angle between the swinging axis R2 of the swinging shaft 133 and the horizontal direction L is denoted by H, the swinging shaft 133 was arranged so as to incline to the horizontal direction L by the angle K defined below (Equation 1). In this Example, the angle α was set to 45° (degrees).

$$K=\alpha-H \quad \text{(Equation 1)}$$

where α is an angle (45° (degrees) in this Example) between the direction of the tensile force F that the roller 11 received from the fiber bundle F and the horizontal direction L; and H is an angle H between the swinging axis R2 of the swinging shaft 133 and the horizontal direction L.

The relationship of the angle K and the state of the guide 1 was recorded, and the results are shown as follows (Table 1).

TABLE 1

| Angle K (°) | Automatic Correction Function Evaluation | Existence or Non-existence of Hunting |
|---|---|---|
| −10 | X | ○ |
| −5 | X | ○ |
| 0 | X | ○ |
| 5 | X | ○ |
| 10 | Δ | ○ |
| 15 | ○ | ○ |
| 20 | ○ | ○ |
| 25 | ○ | ○ |
| 30 | ○ | ○ |
| 35 | Δ | ○ |
| 40 | Δ | X |
| 45 | X | X |

In the above (Table 1),

"Automatic Correction Function Evaluation" denotes whether or not there is a "correction function" in which the roller 11 automatically swings in response to widthwise changes in a traveling path of the fiber bundle Y, "○" denotes that there was the correction function, "×" denotes that there was no correction function, and "Δ" denotes that there was the correction function, but there was a room to be improved. Also, "Existence or Non-existence of Hunting" denotes whether or not the roller 11 swung in a quite short cycle, "○" denotes that there was no hunting, and "×" denotes that there was hunting.

Also, in view of the above results (Table 1), evaluation with scoring in a standard below is performed for "Automatic Correction Function Evaluation" and "Existence or Non-existence of Hunting."

Automatic Correction Function Evaluation: 5 Level Evaluation 5 points: Quite smoothly swung in response to changes in widthwise changes in the traveling path of the fiber bundle Y on the entrance side;

4 points: Smoothly swung in response to widthwise changes in the traveling path of the fiber bundle Y on the entrance side:

3 points: Swung in response to widthwise changes in the traveling path of the fiber bundle Y on the entrance side, but not smoothly swung;

2 points: Swung in response to widthwise changes in the traveling path of the fiber bundle Y on the entrance side, but occasionally not swung; and 1 points: Not swung in response to widthwise changes in the traveling path of the fiber bundle Y on the entrance side.

Existence or Non-Existence of Hunting: 3 Level Evaluation 3 points: No hunting occurred 2 points: Hunting occurred, but ended shortly 1 point: Hunting always occurred The score of the "Automatic Correction Function Evaluation" and the score of the "Existence or Non-Existence of Hunting" according to the evaluation standard and the total evaluation (product of both points) are shown below (Table 2).

TABLE 2

| Angle K (°) | Automatic Correction Function Evaluation | Existence or Non-existence of Hunting | Total Evaluation |
|---|---|---|---|
| −10 | 1 | 3 | 3 |
| −5 | 1 | 3 | 3 |
| 0 | 2 | 3 | 6 |
| 5 | 2 | 3 | 6 |
| 10 | 3 | 3 | 9 |
| 15 | 5 | 3 | 15 |
| 20 | 5 | 3 | 15 |
| 25 | 5 | 3 | 15 |
| 30 | 4 | 3 | 12 |
| 35 | 3 | 2 | 6 |
| 40 | 2 | 1 | 2 |
| 45 | 1 | 1 | 1 |

Figure 7:
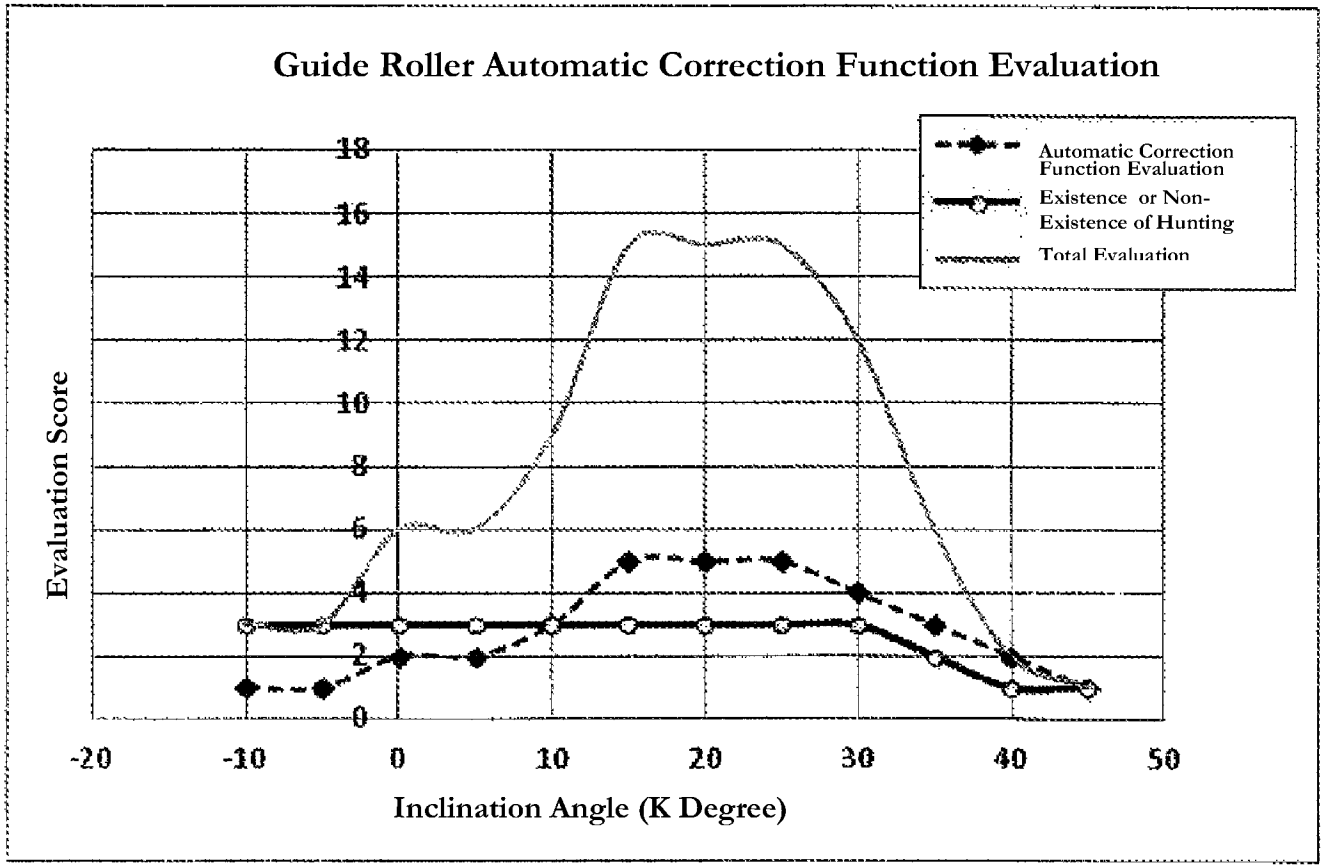
FIG. 7 is a graph showing an evaluation result of hunting and an automatic correction function with respect to an inclination angle of the swinging shaft.

Further, by graphing the above data (Table 2), the results shown in FIG. 7 were obtained. In the graph of FIG. 7, the horizontal axis shows each angle K, and the vertical axis shows the score of the "Automatic Correction Function Evaluation", the score of the "Hunting", and the total evaluation calculated by the product of the "Automatic Correction Function Evaluation" and the "Existence or Non-existence of Hunting."

According to FIG. 7, when the swinging axis R2 is inclined in a manner such that the angle K is within the range of 5 to 35° (degrees) (including 5 and 35° (degrees)), the total evaluation score is maintained approximately 6 points or higher. Therefore, it can be said that it is possible to more stably guide the fiber bundle Y.

Also, when the swinging axis R2 is inclined in a manner such that the angle K is within the range of 10 to 30° (degrees) (including 10 and 30° (degrees)), the total evaluation score is maintained approximately 9 points or higher. It can be said that it is possible to more stably guide the fiber bundle Y. When the angle K is 10 to 30° (degrees), it can be judged that the automatic correction function has been improved remarkably.

Further, when the swinging axis R2 is inclined in a manner such that the angle K is within the range of 15 to 30° (degrees) (including 15 and 30° (degrees)), the total evaluation score is maintained approximately 12 points or higher. Therefore, it can be said that it is possible to more stably guide the fiber bundle Y.

Second Embodiment

Next, a second embodiment of the fiber bundle guide according to the present invention is described with reference to FIGS. 8 and 9.

In the following explanation, structures different from that of the above first embodiment will be described, and the explanation will be omitted for the same structure by allotting the same reference numbers.

Figure 8:
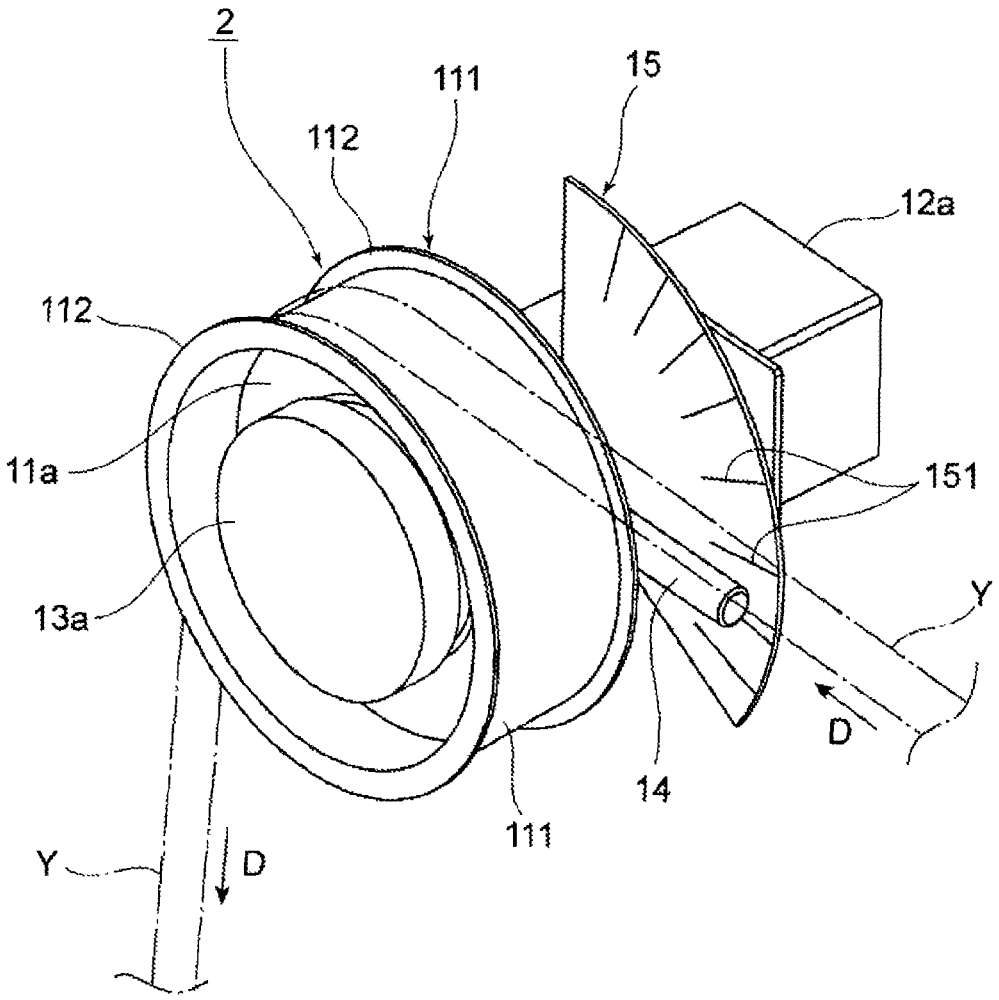
FIG. 8 is a perspective view showing a fiber bundle guide according to a second embodiment.

The fiber bundle guide 2 (hereinafter referred to as "the guide") of this embodiment, as shown in FIG. 8, includes an angle indicating member 14 provided on a side of the support member 12 and a scale board 15 provided adjacent to the angle indicating member 14. Also, in this embodiment, the support member 12 is rotatable with respect to the fixing member 12*a* and is configured to be fixed at any arbitral rotational amount.

Figure 9:
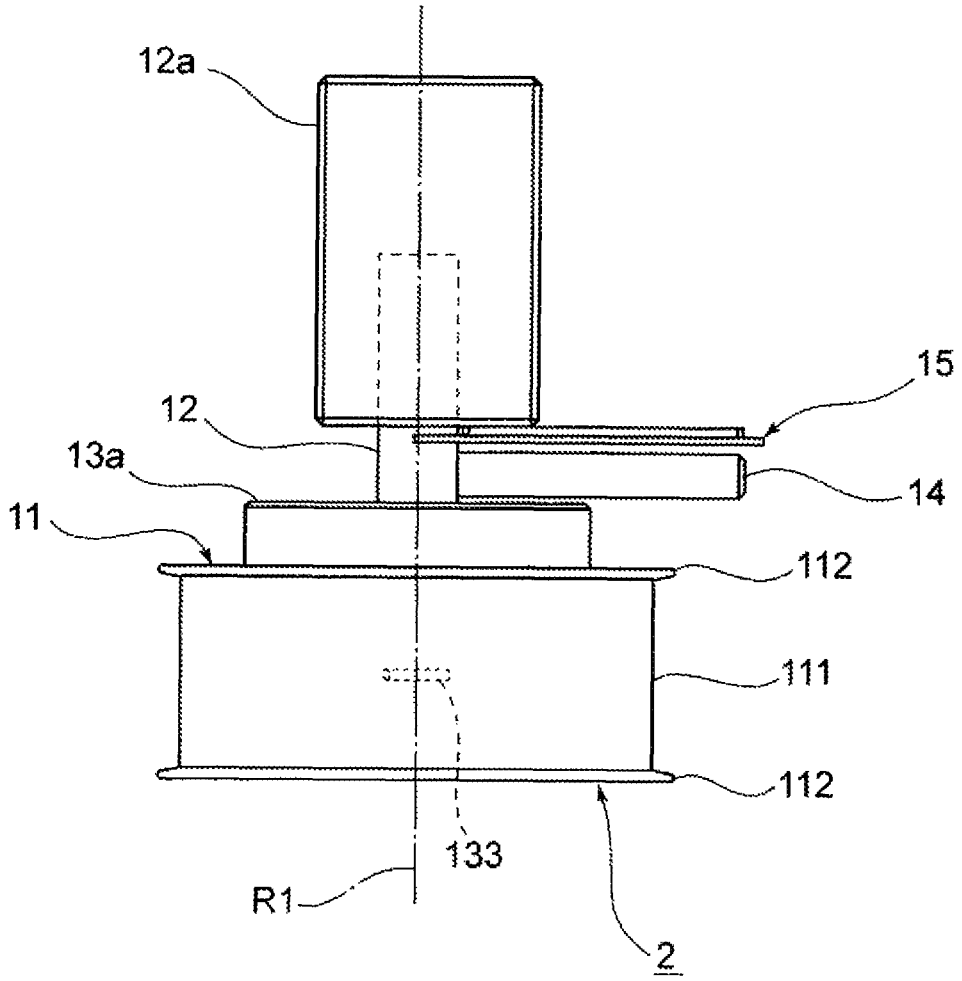
FIG. 9 is a plan view showing the fiber bundle guide shown in FIG. 8.

The angle indicating member 14, as shown in FIG. 9, is a rod-like member which is fixed in a manner to protrude in a horizontal direction L from a side surface of a fixing member 12*a*. By rotating this angle indicating member 14 in the circumferential direction either manually or electrically, the inclination angle H of the swinging axis R2 of the swinging shaft 133 can be changed via the support member 12. Further, by recognizing the position, the angle, etc., of the angle indicating member 14, the position, the angle, etc., of the swinging axis R2 can be recognized.

The scale board 15, as shown in FIG. 9, is a fan-shaped board member provided adjacent to the angle indicating member 14 in a manner to extend in a direction perpendicular to the support member 12. The scale board 15, as shown in FIG. 8, is provided with a plurality of scale marks extending towards the support member 12 from the outer circumferential edge. For this reason, since the rotation amount of the angle indicating member 14 can be recognized from the position of the angle indicating member 14 with respect to the scale board 15, based on this, the inclination angle H of the swinging axis R2 can be set with high dimensional accuracy.

In this embodiment, the above explanation is directed to the case in which the angle indicating member 14 is provided in a manner to extend in a direction perpendicular to the support member 12, but the angle indicating member is not required to be perpendicular as mentioned above.

Further, the above explanation is directed to the case in which the angle indicating member 14 is of a rod-like shape, but the angle indicating member can be of any shape.

Further, the above explanation is directed to the case in which the scale board 15 is provided in a manner to extend in a direction perpendicular to the support member 12, but the scale board is not required to be perpendicular as mentioned above.

Further, the above explanation is directed to the case in which the scale board 15 is a fan-shaped board member, but the scale board can be of any shape.

Further, the above explanation is directed to the case in which the scale board 15 is provided, but it can be configured not to provide such a scale board.

Embodiments of the present invention have been described with reference to the figures, however, it should be noted that the present invention is not limited to the embodiments shown in the figures. Various modifications and/or changes can be made to the embodiments shown in the figures within the same range as in the present invention or within the equivalent range.

The terms and descriptions used herein are used only for explanatory purposes and the present invention is not limited to them. Accordingly, the present invention allows various design-changes falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, the terminology "present invention" or "invention" is meant as a non-specific, general reference and may be used as a reference to one or more aspects within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features.

The invention claimed is:

1. A fiber bundle guide for guiding a flat fiber bundle, comprising:

a cylindrical guide roller having a circumferential surface around which the fiber bundle is to be placed;

a support member configured to support the cylindrical guide roller;

a bearing arranged between the guide roller and the support member to rotatably support the cylindrical guide roller around the support member, the bearing including an outer ring and an inner ring; and a swinging shaft arranged radially inward of the inner ring in a manner to extend in a direction perpendicular to a rotational axis of the guide roller to pivotally connect the inner ring to the support member.

2. The fiber bundle guide as recited in claim 1, wherein the swinging shaft is arranged at a position eccentrically shifted in a radius direction with respect to a center point of the guide roller.

3. The fiber bundle guide as recited in claim 1, wherein the swinging shaft is inclined with respect to an incoming traveling direction of a fiber bundle put around the circumferential surface of the guide roller.

4. The fiber bundle guide as recited in claim 3, wherein the incoming traveling direction is in parallel to a horizontal direction.

5. The fiber bundle guide as recited in claim 1, further comprising an angle indicating member extending from a side of the support member in a direction intersecting with the support member.

6. The fiber bundle guide as recited in claim 5, further comprising a scale board extending in a direction intersecting with the support member at a position adjacent to the angel indicating member.

7. The fiber bundle guide as recited in claim 1, the swinging shaft is arranged so as to incline with respect to the horizontal direction so that an angle K expressed by a following Equation 1 falls within a range of 5 to 35° (degrees), $$K=\alpha-H \quad \text{(Equation 1)}$$

wherein

α is an angle between a direction of a tensile force that the guide roller receives from the fiber bundle and the horizontal direction; and H is an angle between a swinging axis of the swinging shaft and the horizontal direction.

8. The fiber bundle guide as recited in claim 7, wherein the angle K is within a range of 10 to 30° (degrees).

9. The fiber bundle guide as recited in claim 7, wherein the angle K is within a range of 15 to 30° (degrees).

10. A fiber bundle guide for guiding a flat fiber bundle in which a plurality of fibers are gathered, comprising:

a cylindrical guide roller having a circumferential surface around which the fiber bundle is to be placed; and a support member configured to support the guide roller rotatably in a circumferential direction, wherein at a rotatably supporting portion that rotatably supports the guide roller around the support member, an axis receiving member arranged at a center part of the guide roller, an axis body slidably engaged with an inner side of the axis receiving member, and a swinging shaft arranged at an inner side of the axis body so as to extend in a direction perpendicular to a rotational axis of the guide roller to pivotally support the support member are provided, and the guide roller rotates about the support member in response to a traveling of the fiber bundle, and swings about the swinging shaft in response to widthwise changes in a traveling path of the fiber bundle.

11. The fiber bundle guide as recited in claim 10, wherein the swinging shaft is arranged at a position eccentrically shifted in a radius direction with respect to a center point of the guide roller.

12. The fiber bundle guide as recited in claim 10, further comprising an angle indicating member extending from a side of the support member in a direction intersecting with the support member.

13. The fiber bundle guide as recited in claim 12, further comprising a scale board extending in a direction intersecting with the support member at a position adjacent to the angel indicating member.

14. The fiber bundle guide as recited in claim 10, wherein the swinging shaft is arranged so as to incline with respect to the horizontal direction so that an angle K expressed by a following Equation 1 falls within a range of 5 to 35° (degrees), $$K=\alpha-H \quad \text{(Equation 1)}$$

wherein

α is an angle between the direction of a tensile force that the guide roller receives from the fiber bundle and the horizontal direction; and H is an angle between the swinging axis of the swinging shaft and the horizontal direction.

15. The fiber bundle guide as recited in claim 14, wherein the angle K is within a range of 10 to 30° (degrees).

16. The fiber bundle guide as recited in claim 14, wherein the angle K is within a range of 15 to 30° (degrees).

* * * * *